US008444157B2

(12) United States Patent
Pryor et al.

(10) Patent No.: US 8,444,157 B2
(45) Date of Patent: May 21, 2013

(54) WHEEL SET ATTACHMENT FOR FLOOR MAINTENANCE EQUIPMENT

(76) Inventors: Mark Pryor, Bakersfield, CA (US); Frederick A Prince, Bakersfield, CA (US)

( * ) Notice: Subject to any disclaimer, the term of this patent is extended or adjusted under 35 U.S.C. 154(b) by 492 days.

(21) Appl. No.: 12/755,189

(22) Filed: Apr. 6, 2010

(65) Prior Publication Data

US 2010/0251513 A1 Oct. 7, 2010

Related U.S. Application Data

(60) Provisional application No. 61/212,117, filed on Apr. 6, 2009, provisional application No. 61/257,604, filed on Nov. 3, 2009.

(51) Int. Cl.
*B62B 1/08* (2006.01)

(52) U.S. Cl.
USPC ..... 280/63; 280/767

(58) Field of Classification Search
USPC ..... 280/47.131, 47.15, 47.17, 47.24, 280/63, 79.11, 79.5, 767; 451/350, 353; 15/49.1, 50.1
See application file for complete search history.

(56) References Cited

U.S. PATENT DOCUMENTS

| | | | | | |
|---|---|---|---|---|---|
| 2,675,246 | A * | 4/1954 | Arones | 280/43.17 |
| 2,949,619 | A * | 8/1960 | Holt | 15/49.1 |
| 3,027,581 | A * | 4/1962 | Holt | 15/49.1 |
| 3,416,417 | A * | 12/1968 | McIlrath et al. | 404/85 |
| 4,367,880 | A * | 1/1983 | Harding | 280/47.131 |
| 4,742,652 | A * | 5/1988 | Cannan et al. | 451/353 |
| 4,845,798 | A * | 7/1989 | Genovese | 15/98 |
| 5,435,035 | A * | 7/1995 | Fujimoto et al. | 15/49.1 |
| 5,674,120 | A * | 10/1997 | Legatt et al. | 451/350 |
| 5,765,250 | A * | 6/1998 | Lee | 15/49.1 |
| 5,791,004 | A * | 8/1998 | Hammadi | 15/49.1 |
| 5,870,791 | A * | 2/1999 | Gurstein et al. | 15/98 |
| 5,974,626 | A * | 11/1999 | Wood et al. | 15/385 |
| 6,353,957 | B1 * | 3/2002 | Wolfe et al. | 15/49.1 |
| 6,421,868 | B1 * | 7/2002 | Tran | 15/49.1 |
| 6,578,858 | B1 * | 6/2003 | Haddock | 280/47.131 |
| 7,140,060 | B1 * | 11/2006 | Walker | 15/98 |
| 7,686,677 | B2 * | 3/2010 | Peterson | 451/353 |
| 8,070,558 | B2 * | 12/2011 | Young | 451/57 |
| 2003/0192573 | A1 * | 10/2003 | Tran | 134/6 |
| 2007/0187915 | A1 * | 8/2007 | Filiatrault | 280/47.131 |
| 2010/0083451 | A1 * | 4/2010 | Rupp | 15/98 |

* cited by examiner

*Primary Examiner* — J. Allen Shriver, II
*Assistant Examiner* — Travis Coolman
(74) *Attorney, Agent, or Firm* — James M. Duncan, Esq.; Klein DeNatale Goldner

(57) ABSTRACT

A wheel set attachment is used in combination with floor maintenance equipment, such as buffers, sanders, grinders, cleaners, etc. ("buffer"), which are typically equipped with small diameter wheels which make transport difficult. The wheel set attachment is conducive for conveying the device up flights of stairs, over obstacles, or conveying the device any appreciable distance. The wheel set attachment of the present invention easily attaches to the buffer without the need for tools and is quickly removed. Once installed, the wheel set attachment is stable and provides a pair of wheels which function as though integral to the buffer.

6 Claims, 5 Drawing Sheets

WHEEL SET ATTACHMENT FOR FLOOR MAINTENANCE EQUIPMENT

CROSS-REFERENCE TO RELATED APPLICATIONS

This application claims domestic priority to U.S. Provisional Patent Application 61/212,117 filed on Apr. 6, 2009 and U.S. Provisional Patent Application 61/257,604 filed on Nov. 3, 2009

BACKGROUND OF THE INVENTION

The disclosed device generally relates to devices for maintenance of floors, and more specifically to devices to assist in moving floor maintenance equipment to and from a work site where movement of the equipment over considerable distances, over obstacles, or up and down stairs is required.

The free standing equipment used for sanding, cleaning, polishing and buffing floors by a single operator can be unwieldy and difficult to maneuver. These devices typically comprise a motor unit enclosed within a rotary housing having one or more floor engaging rotary implements. A handle member is pivotally connected to the rotary housing, where the handle member extends to the operator's hands, where controls are located for the operator to guide and control the unit. A variety of different rotary implements may be utilized for maintaining a floor, such as brushes, a sanding disc, a polishing disc, etc. These devices typically have a pair of small wheels extending backwardly from the rotary housing, where the wheels must be small enough so they do not make contact with the floor surface when the rotary implement is in full engagement with the floor surface. While these devices perform a variety of different floor maintenance tasks, they are commonly referred to as "buffers", which name will be used herein in description for devices which perform all of these tasks.

The above described buffers are typically heavy, with almost all of the weight carried in the lowermost section of the device where the motor, gearing, and rotary assembly are placed. This weight is advantageous when operating the buffer because it imposes a substantial force against the rotary implement as it rotates on the floor surface. Moving the buffer is relatively easy when the motor is on and the rotary implement is rotating on a floor surface. However, moving the buffer when the motor is off can be quite difficult.

Typically, when not in operation, the above-described buffers are moved by pushing down on the handle to lift the rotary implement off of the floor causing the small built-in wheels at the back of the rotary housing to engage the floor or ground surface. However, because the wheels are small and only engage the ground surface when the handle is pushed a sufficient amount downwardly, the built-in wheels are, at best, suited for straight movements of short distances across generally level terrain. Because of the weight of the buffer, turns on the small wheels can cause the wheel on one side to lift off of the floor surface and cause the wheel on the other side to bind and slide through the turn, such that the operator is essentially dragging the device through the turn. Moving the buffer is particularly difficult when it must be moved long distances, lifted over obstacles such as hoses, curbs, bumps, or taken up or down flights of stairs. Because of the small size of the built-in wheels, the buffer is usually carried up flights of stairs, usually requiring at least two people to carry the heavy unit.

For purposes of this disclosure, the aforementioned built-in wheels will hereinafter be referred to as "rollers" to avoid confusion with the wheels of the present invention. However, it is to be appreciated that, as used herein, the term "rollers" refers to the wheels typically found on the various floor maintenance equipment for which the presently disclosed apparatus is suited.

SUMMARY OF THE INVENTION

The present invention is used in combination with a buffer to address the problem discussed above. The type of buffer utilized in combination with the present invention comprises a rotary implement coupled to a motor, a rotary housing, a backwardly extending roller assembly comprising a left side roller and a right side roller attached to the rotary housing, and a handle assembly pivotally attached to the rotary housing. The rotary implement may be brushes, a sanding disc, a polishing disc, or other implements known to be used with equipment of this type. The buffer has an operating position in which the rotary implement is in engaging contact with the floor and the rollers do not touch the floor. The buffer also has a traveling position in which the rotary implement is not in full engagement with the floor and the rollers are in full engagement with the floor. It is to be appreciated that these positions are so described without having the disclosed detachable wheel set attached to the buffer, because once the attached wheel set is attached, the rollers do not engage the floor. The present invention is a detachable wheel set used in combination with previously described buffer, the detachable wheel set comprising an attachment bracket which has means for manual attachment to the rotary housing (i.e., without any tools required) and manual detachment from the rotary housing. The attachment bracket comprises a front, back, left side and a right side. A left wheel is disposed on the left side of the attachment bracket and a right side wheel is disposed on the right side of the attachment bracket. The wheels may be attached to individual axles on the left side and right side of the attachment bracket, or to other wheel attachment mechanisms, such as a single axle. The left side wheel and the right side wheel are substantially larger in diameter than the built-in left side roller and the right side roller of the buffer.

Once the attachment bracket is attached to the buffer, the built-in left side roller and right side roller are "captured" by a mechanism on the attachment bracket, such that the rollers do not engage the ground, but are suspended above ground by the attachment bracket, so that the larger wheels of the invention make contact with the ground. Once the buffer is moved to the desired location, the wheel attachment device is easily removed by foot or hand.

DETAILED DESCRIPTION OF THE EMBODIMENTS

Figure 1:
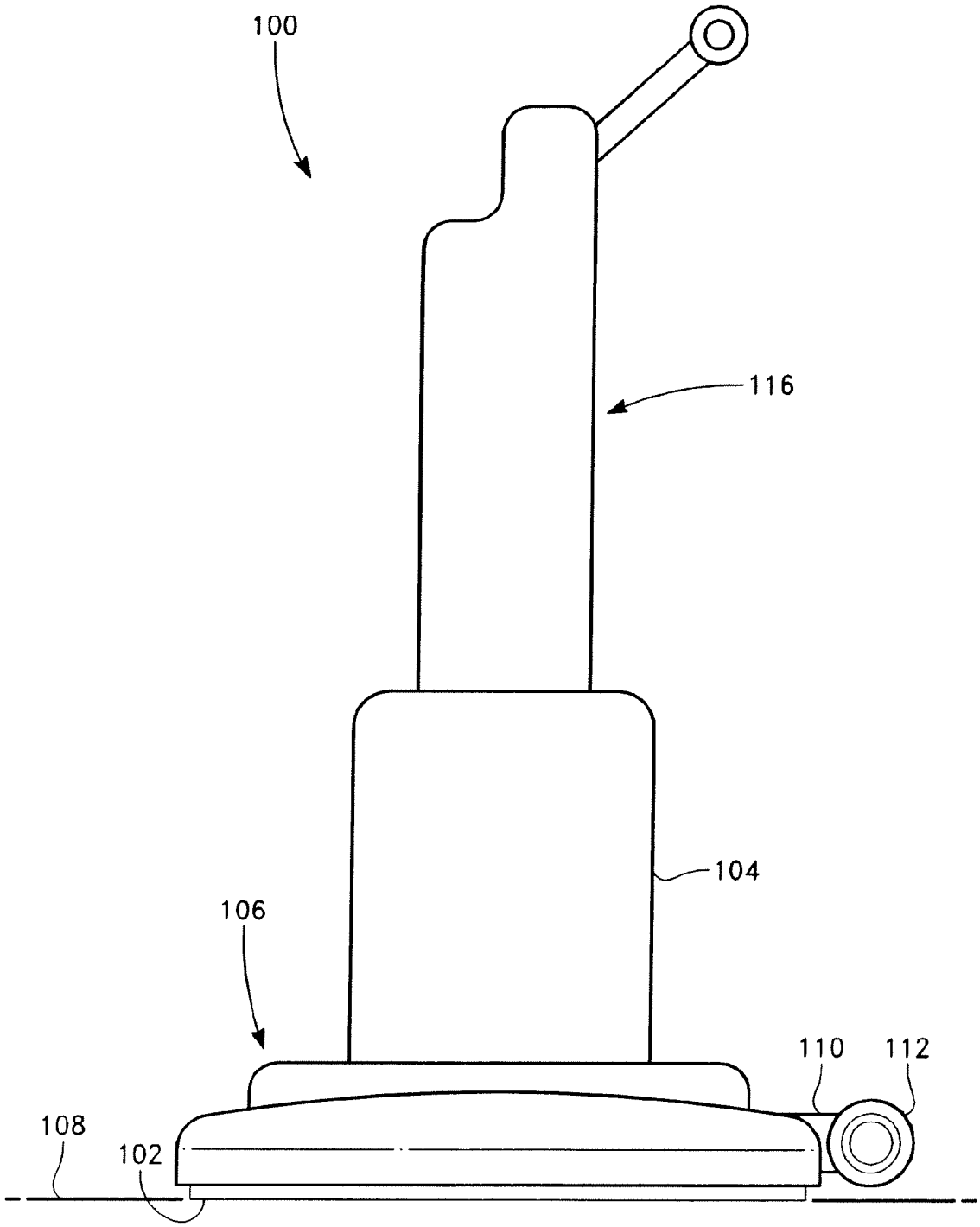
FIG. 1 shows a side view of the type of buffer which may be used in combination with embodiments of the disclosed wheel attachment set.
Figure 2:
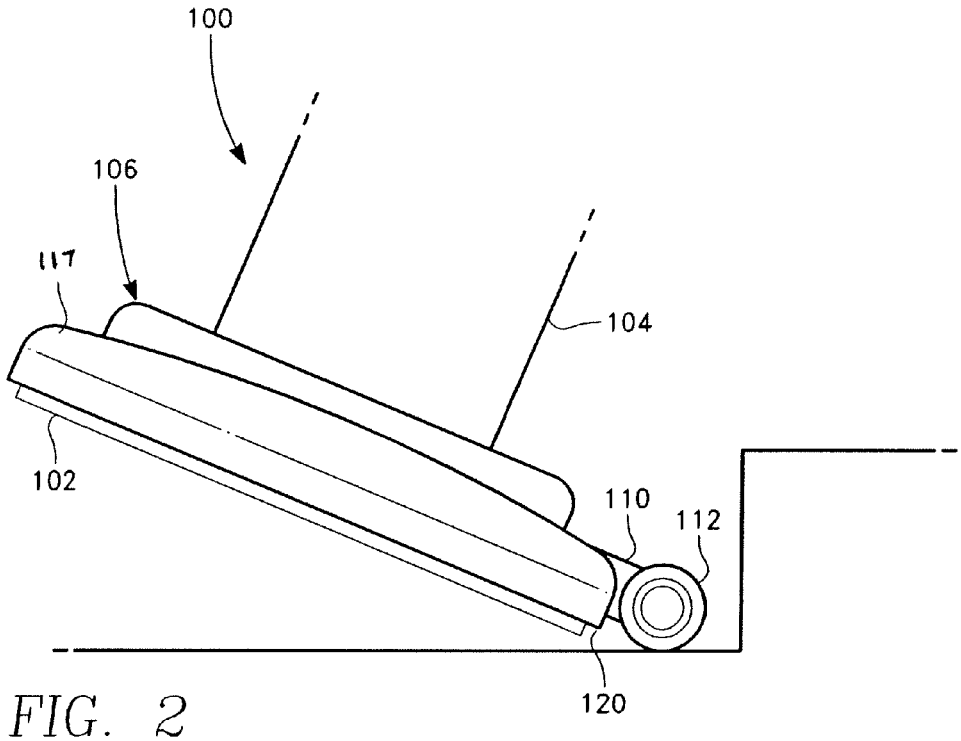
FIG. 2 shows a view of the buffer of FIG. 1 being moved up a flight of stairs without the disclosed attachable wheel set, illustrating one of the problems the disclosed wheel attachment set solves
Figure 3:
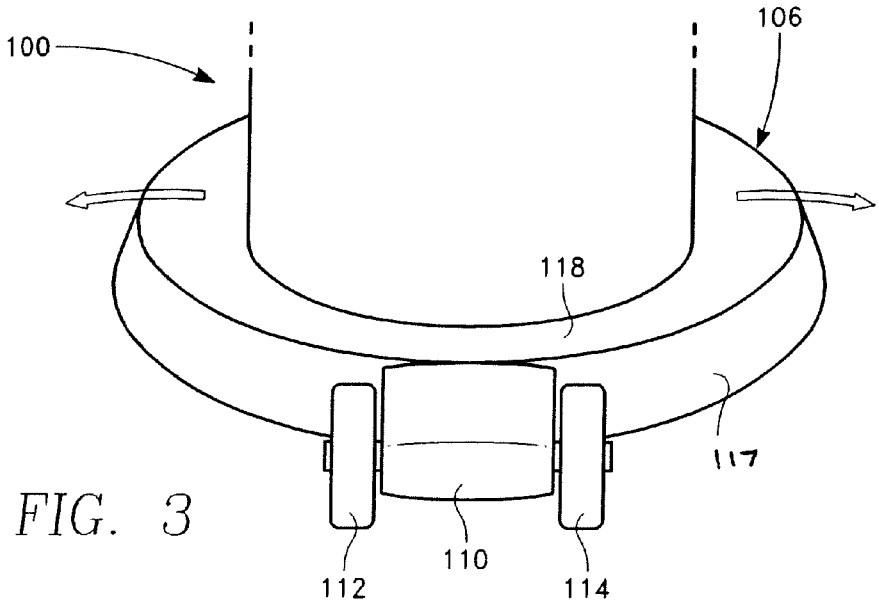
FIG. 3 illustrates the instability of the buffer when rolled on its built-in wheels.

Referring now to the Figures, FIGS. 1 through 3 show an embodiment of floor maintenance equipment, a buffer 100, with which embodiments of the attached wheel set may be used in combination. Buffer 100 comprises a rotary implement 102 which is coupled to a motor 104, typically with a planet gear drive. The motor 104, gear drive, and rotary implement are contained within a rotary housing 106. The rotary housing 106 provides a shield around the rotary implement 102. The rotary housing 106 contains the dust, debris, etc. which the rotary implement may throw off as it rotates on the floor 108. The rotary housing 106 comprises a backwardly extending roller assembly 110 which comprises a left side roller 112 and right side roller 114. The rotary housing 106 further comprises a handle assembly 116 which is pivotally attached to the rotary housing.

As shown in FIGS. 2-3, the buffer 100 presents difficulties when trying to maneuver it when the motor is not turned on. As shown in FIG. 2, the built-in rollers 112, 114 are, by necessity, small in diameter. As shown in FIG. 2, the rollers are not large enough to navigate steps, such that it is necessary to manually lift the buffer 100 up each step, which is difficult because of the weight of the buffer. As shown in FIG. 3, when the buffer 100 is tilted back and a turn is attempted, the rollers 112, 114 do not easily navigate the turn, and often have to be dragged through the turn.

Figure 4:
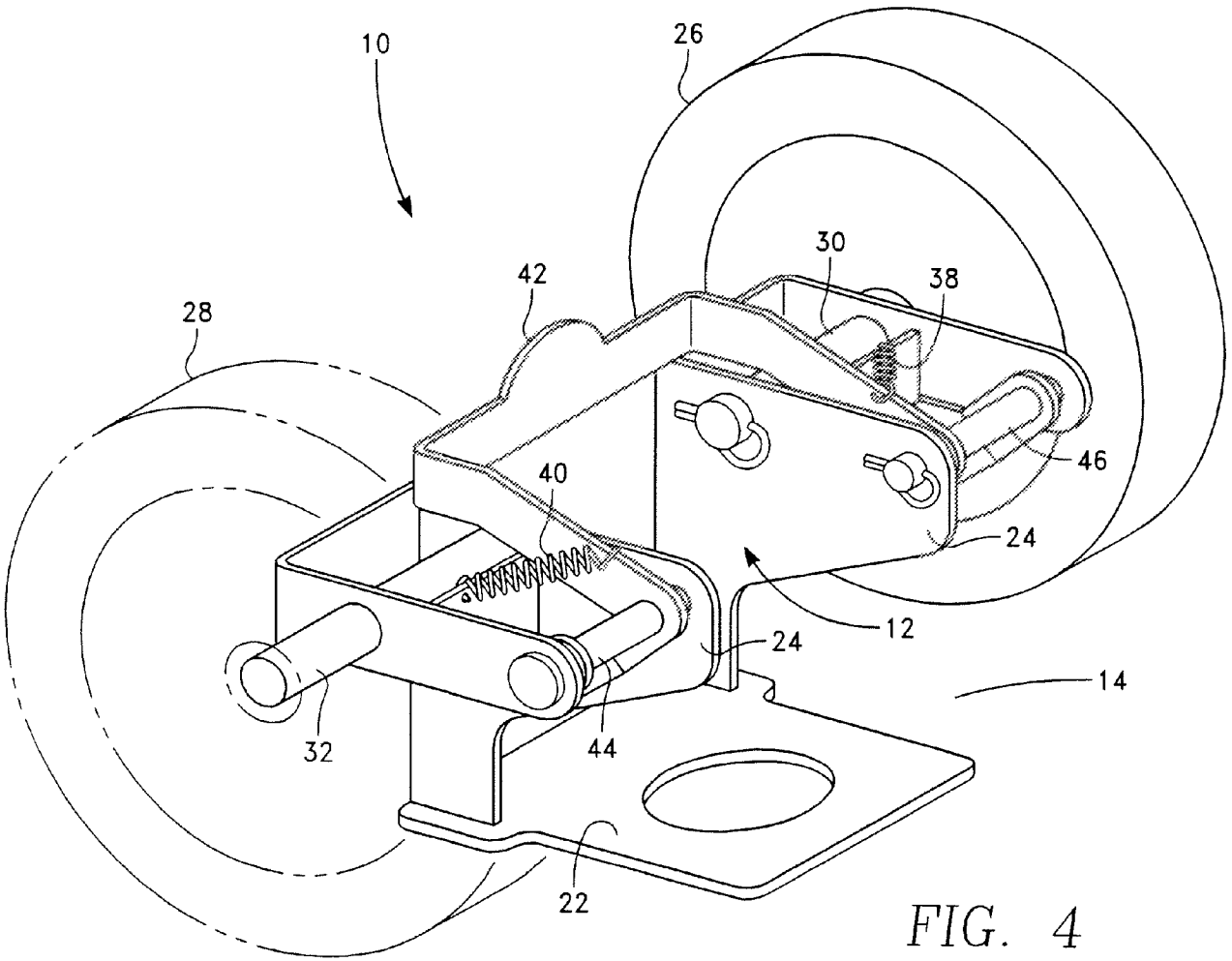
FIG. 4 shows a perspective view of an embodiment of an embodiment of the attachable wheel set which may be used in combination with a buffer.

FIG. 4 shows an embodiment of the disclosed attachable wheel set 10. The attachable wheel set comprises an attachment bracket 12. The attachment bracket 12 has a front 14, a back 16, a left side 18 and a right side 20. The attachment bracket 12 has means for manual attachment to the rotary housing 106 of the buffer. As can be seen in the drawings, the rotary housing 106 has a lower section 117 which covers the rotary implement 102 from the top. The attachment bracket 12 comprises structure which are configured to engage the lower section at its top surface 118 and at its bottom surface 120 in such a manner as to install quickly without the need for tools, and to be likewise removed quickly without tools. Among various structure which may be utilized as means to manually attach the wheel set 10 to rotary housing and detachment to and from the rotary housing 106, the attachment bracket may comprise a lower plate 22 and a pair of upper arms 24. Lower plate 22 fits beneath bottom surface 120, while upper arms 24 fit over top surface 118, such that the rotary housing 106 is received relatively snugly between these structures. However, it is to be appreciated that other structural members may also be utilized to engage the rotary housing.

Figure 6:
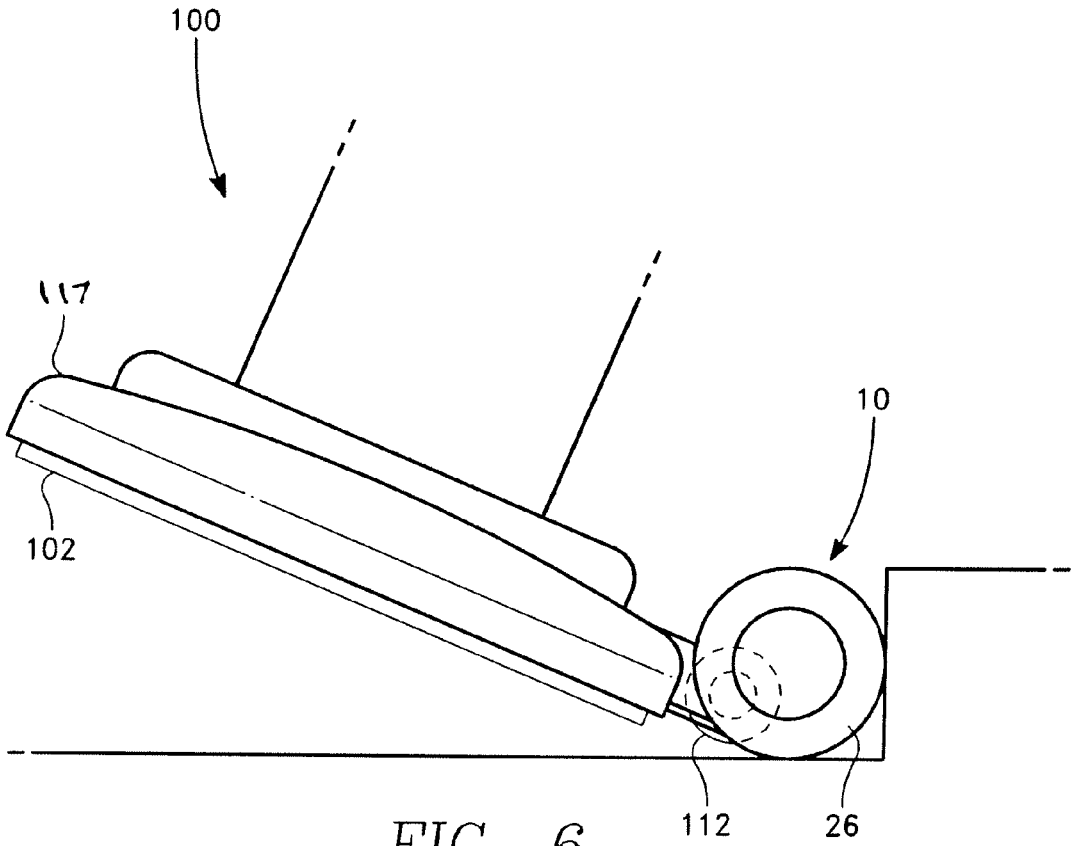
FIG. 6 a side view of an embodiment of the attachable wheel set attached to a buffer, illustrating how the larger wheels facilitate transporting a buffer upstairs.

The attachable wheel set 10 further comprises a left side wheel 26 and a right side wheel 28. The left side wheel 26 may be disposed on a left side axle 30 which is attached on the left side 18 of attachment bracket 12. Likewise, right side wheel 28 may be disposed on a right side axle 32 attached to the right side 20 of the attachment bracket 12. As illustrated in FIG. 6, the diameters of left side wheel 26 and right side wheel 28 are substantially larger than left side roller 112 and right side roller 114, thus greatly facilitating movement of the buffer 100 up stairs or over large obstacles.

Figure 5:
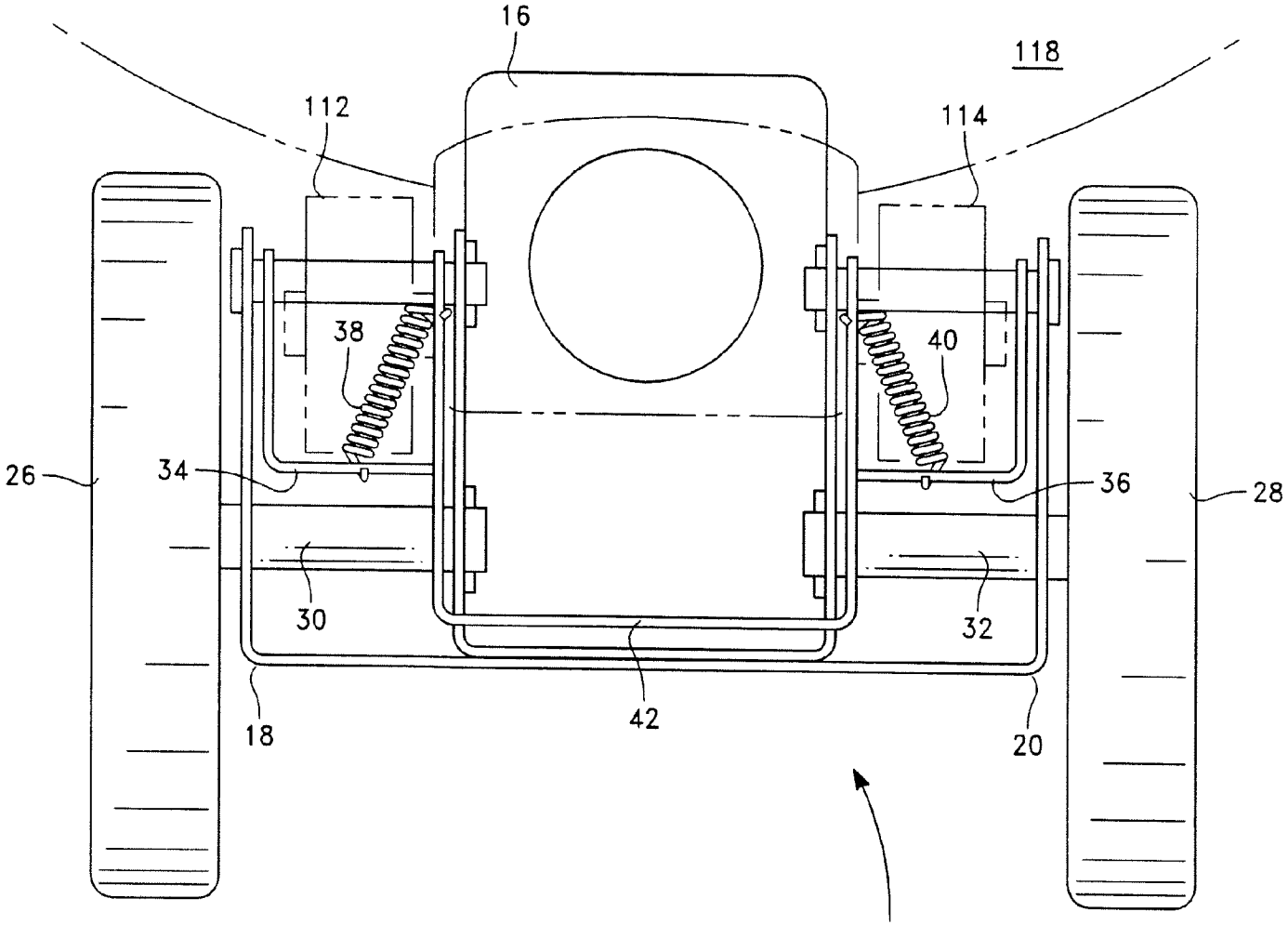
FIG. 5 shows a rear view of an embodiment of the attachable wheel set installed on a buffer.

The backwardly extending roller assembly 110 of the buffer 100 is received within the attachment bracket 12, as best shown in FIG. 5. Rollers 112, 114 may be captured within structure in the attachment bracket 12 for added stability between the attachable wheel set 10 and the buffer 100. Various means may be employed for retaining or engaging the rollers 112, 114 to the attachable wheel set. For example, the attachment bracket 12 may comprise a left roller engagement plate 34 pivotally attached to the left side 18 of the attachment bracket and a right roller engagement plate 36 pivotally attached to the right side 20 of the attachment bracket. Each of these roller engagement plates 34, 36 may further comprise biasing means, such as springs 38, 40 for locking the left roller engagement plate to the left roller 112 and the right roller engagement plate to the right roller 114.

The roller engagement plates 34, 36 may be combined into a single unit, such as roller engagement yoke 42, best shown in FIG. 4. Roller engagement yoke 42 is pivotally attached to attachment bracket 12, being attached to a left side pivot rod 44 and a right side pivot rod 46.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. A detachable wheel set used in combination with a motorized device used for maintaining a floor, the motorized device of the type comprising a rotary implement coupled to a motor, a rotary housing, a backwardly extending roller assembly comprising a left side roller and a right side roller attached to the rotary housing, and a handle assembly pivotally attached to the rotary housing, the detachable wheel set comprising:

an attachment bracket having means for manual attachment and detachment to and from the rotary housing, the attachment bracket comprising a front, back, left side and right side;

a roller engagement means which releasably engages the rollers;

a left side axle attached to the left side of the attachment bracket and a right side axle attached to the right side of the attachment bracket;

a left side wheel disposed on the left side axle and a right side wheel disposed on the right side axle, the left side wheel and the right side wheel larger in diameter than the left side roller and the right side roller.

2. The detachable wheel set of claim 1 wherein the roller engagement means comprises a left roller engagement plate pivotally attached to the left side of the attachment bracket and a right roller engagement plate pivotally attached to the right side of the attachment bracket.

3. The detachable wheel set of claim 2 further comprising biasing means for locking the left roller engagement plate to the left roller and the right roller engagement plate to the right roller.

4. The detachable wheel set of claim 1 wherein the roller engagement means comprises a left side pivot rod, a right side pivot rod, and a roller engagement yoke pivotally attached to the left side pivot rod and the right side pivot rod, the roller engagement yoke comprising a left roller engagement plate and a right roller engagement plate.

5. The detachable wheel set of claim 4 further comprising biasing means for locking the left roller engagement plate to the left roller and the right roller engagement plate to the right roller.

6. The detachable wheel set of claim 1 wherein the means for manual attachment and detachment to and from the rotary housing comprises a lower plate which fits beneath the rotary housing adjacent to the rotary implement and a pair of upper arms which fit over the rotary housing.

* * * * *